US006168466B1

(12) United States Patent
Chiou

(10) Patent No.: US 6,168,466 B1
(45) Date of Patent: Jan. 2, 2001

(54) SHIELDED ELECTRICAL CONNECTOR

(75) Inventor: Song-Rong Chiou, Lin-Kou (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/309,618

(22) Filed: May 11, 1999

(30) Foreign Application Priority Data

Aug. 27, 1998 (TW) ..... 87214068

(51) Int. Cl.[7] ..... H01R 13/648
(52) U.S. Cl. ..... 439/607; 439/609; 439/79
(58) Field of Search ..... 439/79, 607, 609

(56) References Cited

U.S. PATENT DOCUMENTS

| | | | | |
|---|---|---|---|---|
| 4,337,989 | * | 7/1982 | Asick et al. | 439/609 |
| 4,936,795 | * | 6/1990 | Kawai et al. | 439/609 |
| 5,195,911 | * | 3/1993 | Murphy | 439/607 |
| 5,637,015 | * | 6/1997 | Tan et al. | 439/607 |

* cited by examiner

*Primary Examiner*—Lincoln Donovan
*Assistant Examiner*—Brian S. Webb

(74) *Attorney, Agent, or Firm*—Wei Te Chung

(57) ABSTRACT

An electrical connector comprises an insulative housing (1) having two side faces (100, 101) connected to a front face (104) and a rear face (102), a top face (103) connected to the side faces (100,101), the front face (103) and the rear face (102). The side faces (100,101) of the housing (1) each respectively defines a guiding channel (13,14) along a longitudinal direction thereof. The rear face (102) of the housing (1) has two ends respectively extending beyond the side faces (100,101) and each end defines a slot (17,18) therein communicating with the guiding channel (13,14) of the corresponding side face (100,101). A first metallic shielding (2) has a front face (202) and two side faces (200,201) connected to two ends of the front face (202), and two rear tabs (27,28) respectively extending from the side faces (200,201) for engaging within the slots (17,18) of the rear face (102) of the housing (1) when the front face (202) and the side faces (200,201) of the first metallic shielding (2) are in contact with the front face (104) and the side faces (100,101) of the housing (1). A second metallic shielding (3) has a top face (302) and two side faces (300,301) extending downward from the top face (302) for engagement between the side faces (200,201) of the first metallic shielding (2) and the side faces (100,101) of the housing (1), wherein the top face (302) of the second metallic shielding (3) covers the top face (103) of the housing (1).

13 Claims, 7 Drawing Sheets

SHIELDED ELECTRICAL CONNECTOR

BACKGROUND OF THE INVENTION

1. Field of the Invention

The present invention relates to an electrical connector, and particularly to an electrical connector having a well shielding structure for configuring to an insulative housing thereof with satisfactory retention.

2. The Prior Art

Advanced electrical connectors, particularly high frequency electrical connectors, such as IEEE 1394 connectors, are covered with a corresponding shielding for suppression of noise during signal transmission. Some related patents are Taiwan Patents Nos. 85216816, 85212192. Although these connectors as disclosed have a shielding structure for suppression of noise. However, the configuration between the shielding structure and the insulative housing is not stable thus causing unwanted loose engagement therebetween. Additionally, the shielding structure is apt to deform to an unwanted extent during configuration with the housing therefore it is requisite to provide a reinforcing part by which the shielding structure can be maintained in a stable shape during configuration with the housing.

SUMMARY OF THE INVENTION

The primary purpose of the present invention is to provide an improved electrical connector including an insulative housing and a metallic shielding structure and the shielding structure has a reinforcing part to maintain the shape thereof during assembly with the housing.

Another purpose of the present invention is to provide an improved electrical connector having a good shielding effect for suppression of noise.

A further purpose of the present invention is to provide an improved electrical connector having a simple shielding structure easily manufactured.

In accordance with one aspect of the present invention, an electrical connector comprises an insulative housing having two side faces connected to a front face and a rear face, a top face connected to the side faces, the front face and the rear face. The side faces of the housing each respectively defines a guiding channel along a longitudinal direction thereof. The rear face of the housing has two ends respectively extending beyond the side faces and each end defines a slot therein communicating with the guiding channel of the corresponding side face. A first metallic shielding has a front face and two side faces connected to two ends of the front face, and two rear tabs respectively extending from the side faces for engaging within the slots of the rear face of the housing when the front face and the side faces of the first metallic shielding are in contact with the front face and the side faces of the housing. A second metallic shielding has a top face and two side faces extending downward from the top face for engagement between the side faces of the first metallic shielding and the side faces of the housing, wherein the top face of the second metallic shielding covers the top face of the housing.

DETAILED DESCRIPTION OF THE PREFERRED EMBODIMENT

Figure 1:
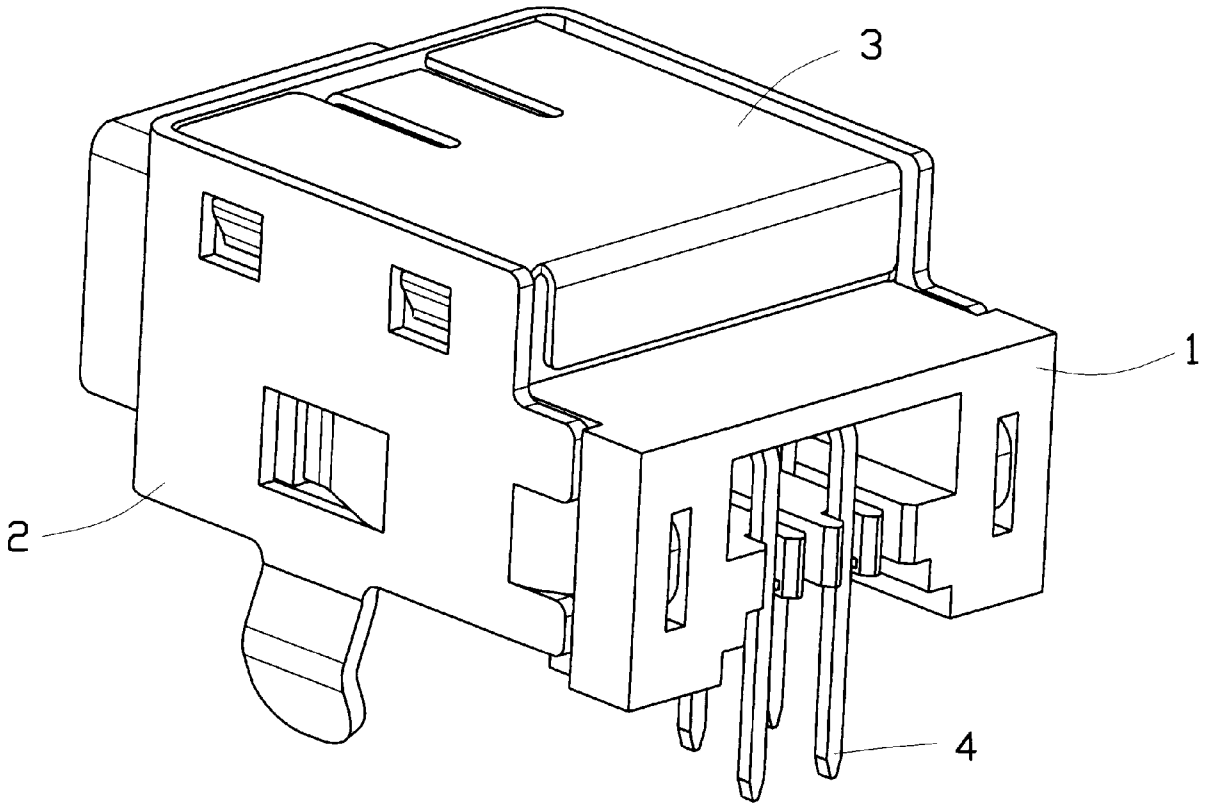
FIG. 1 is a perspective view of an electrical connector in accordance with the present invention.

Referring to FIGS. 1, 2, 3, and 4, an electrical connector in accordance with the present invention comprises an insulative housing 1 for receiving a plurality of contacts 4, a first metallic shielding 2 and a second metallic shielding 3 for enclosing the housing 1 and suppressing noise. The contact 4 is a right-angled one and has a horizontally extended contacting portion 40, an engaging portion 41 extended from the contacting portion 40, and a soldering portion 42 perpendicular to the engaging portion 41. The housing 1 has a first side face 100, a second side face 101, a front face 104 connected to the side faces 100, 101, a rear face 102 opposite the front face 104 and connected to the side faces 100, 101, and a top face 103 connected to the side faces 100, 101 and the front and rear faces 104, 102, wherein the rear face 102 has two ends respectively extend beyond the side faces 100, 101. An intermediate plate 5 is integrated in the housing 1 for retaining the contacting portions 40 of the contacts 4 in a lower surface thereof. The intermediate plate 5 has a Z-shaped structure (not shown, since it is well known in this field), wherein a vertical portion thereof (not shown) defines four holes (not shown) for interferentially retaining the engaging portions 41 of the contacts 4. First tapered protrusions 11, 12 are respectively formed on upper portions of the first and second side faces 100, 101 of the housing 1. First and second guiding channels 13, 14 are respectively defined in lower portions of the first and second side faces 100, 101. Second tapered protrusions 15, 16 are respectively projected from one end of the guiding channels 13, 14 and each has a guiding face 151, 161 and a stopping edge 152, 162. The rear face 102 defines a first slot 17 and a second slot 18 at two ends thereof respectively in communication with the first and the second channels 13, 14. The top face 103 defines a reception cutout 19 communicating with the front face 104. A ledge 191 is projected from an inner-most wall of the cutout 19. Four recesses 50 are defined in a rear edge of the intermediate plate 5 and the depths thereof are different for adjacent ones but the same for spaced ones for receiving a section of the soldering portions 42 of the contacts 4 in two lines.

Figure 3:
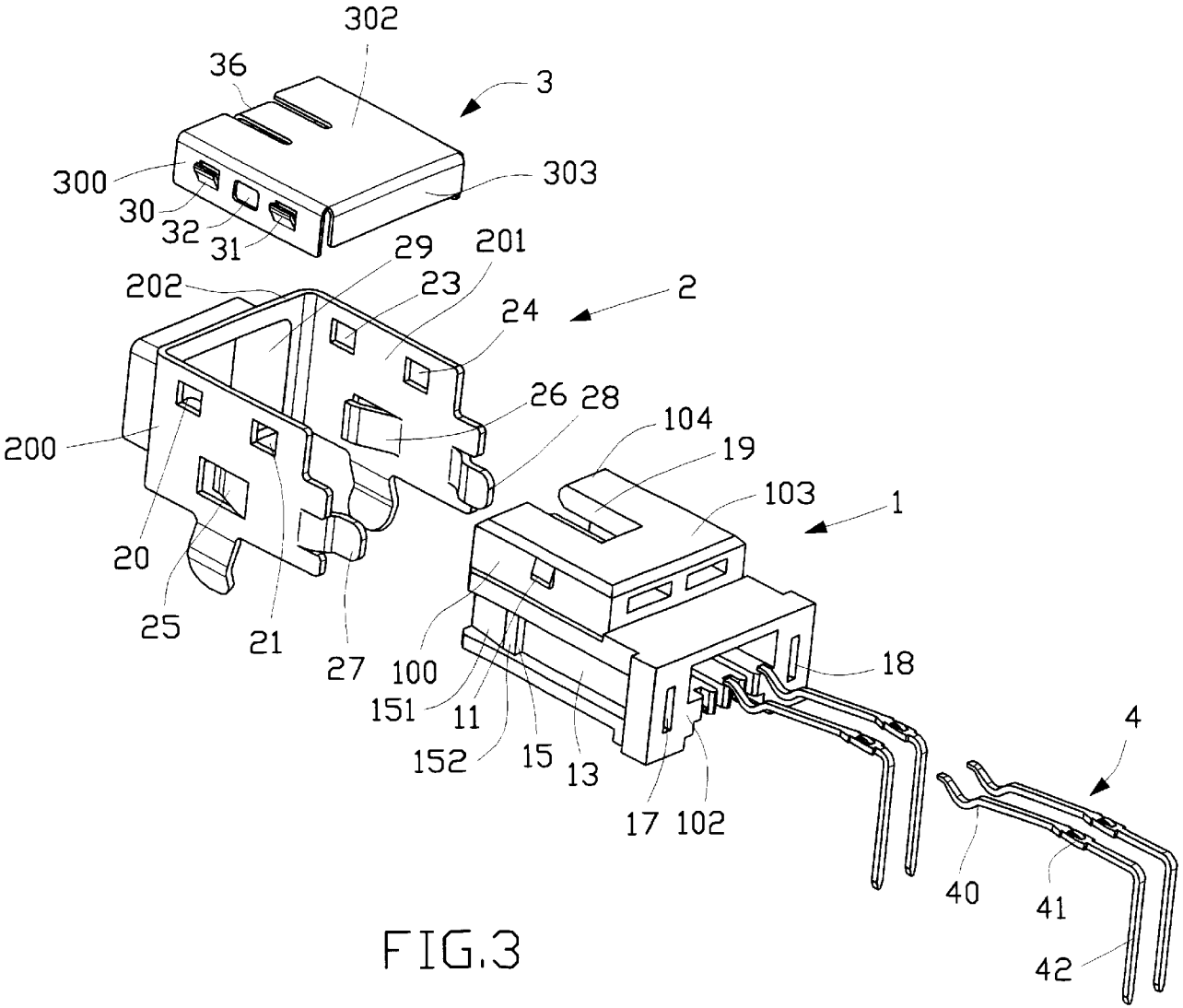
FIG. 3 is an exploded view of the connector of FIG. 1.

Particularly referring to FIG. 3, the first shielding 2 is formed from a single metallic plate by stamping and bending. The first shielding 2 comprises a first side face 200, a second side face 201, and a front face 202 and together form a U-shaped structure for respectively enclosing the first side face 100, the second side face 101, and the front face 104 of the housing 1.

Figure 2:
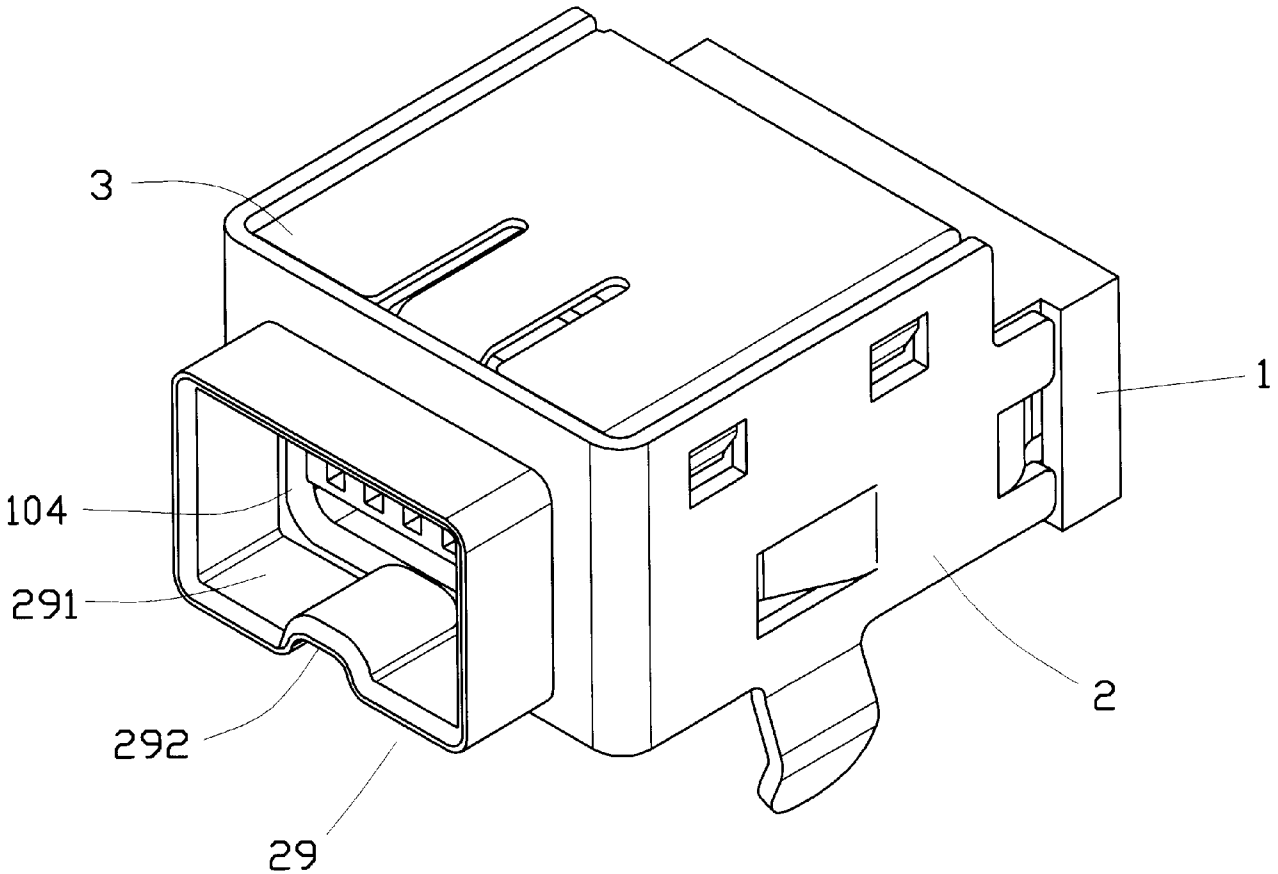
FIG. 2 is another view of FIG. 1.

Particularly referring to FIG. 2, a hollow frame 29 projects from the front face 202 of the first shielding 2 and defines a reception opening 291 in communication with internal space of the housing 1 for noise depression when a complementary connector is inserted thereinto. A dimple 292 is formed on a periphery of the hollow frame 29 for prevention of disorientation of insertion of a complementary connector (not shown).

Figure 4:
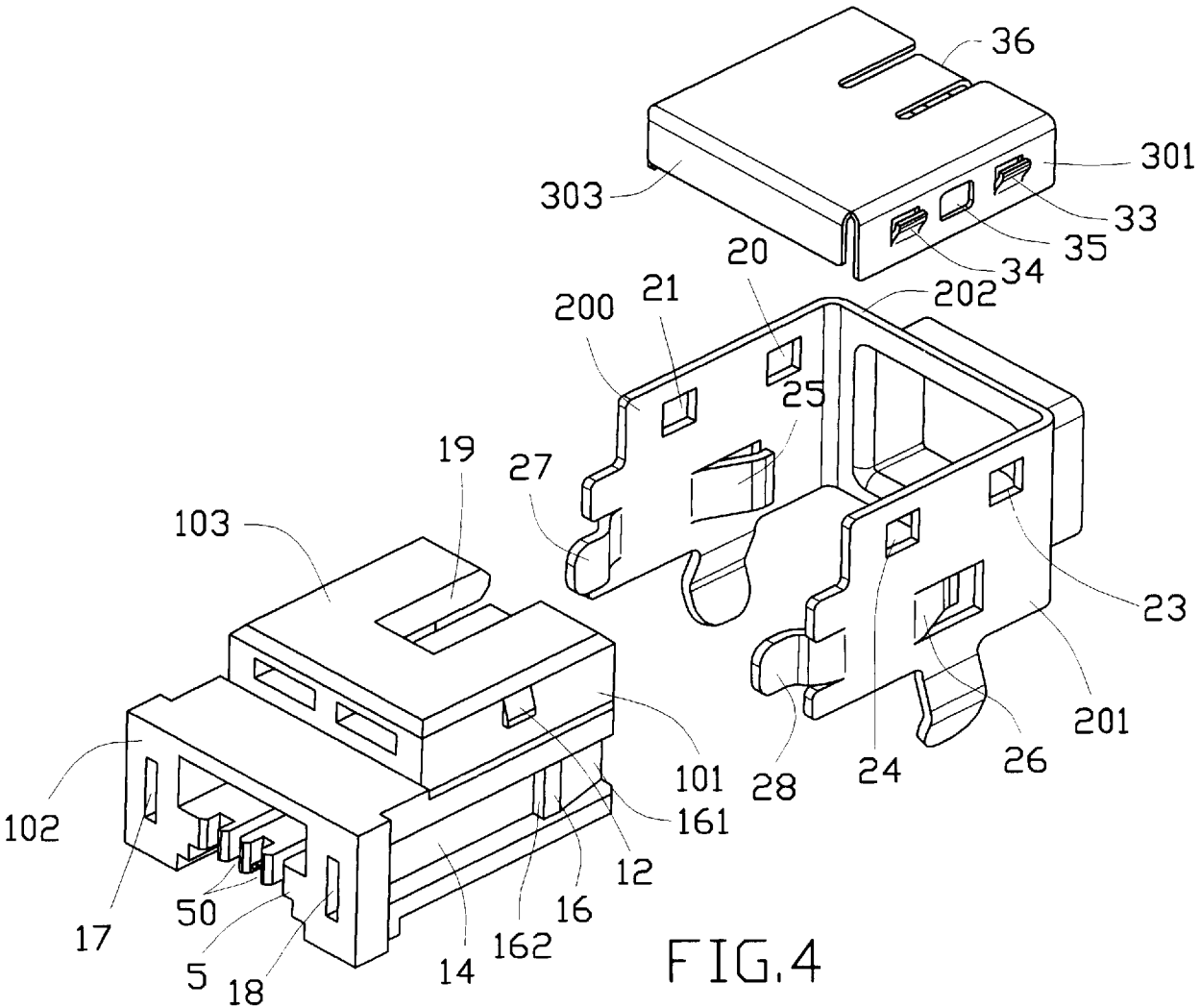
FIG. 4 is further another view of FIG. 3, with the contacts thereof being omitted.
Figure 5:
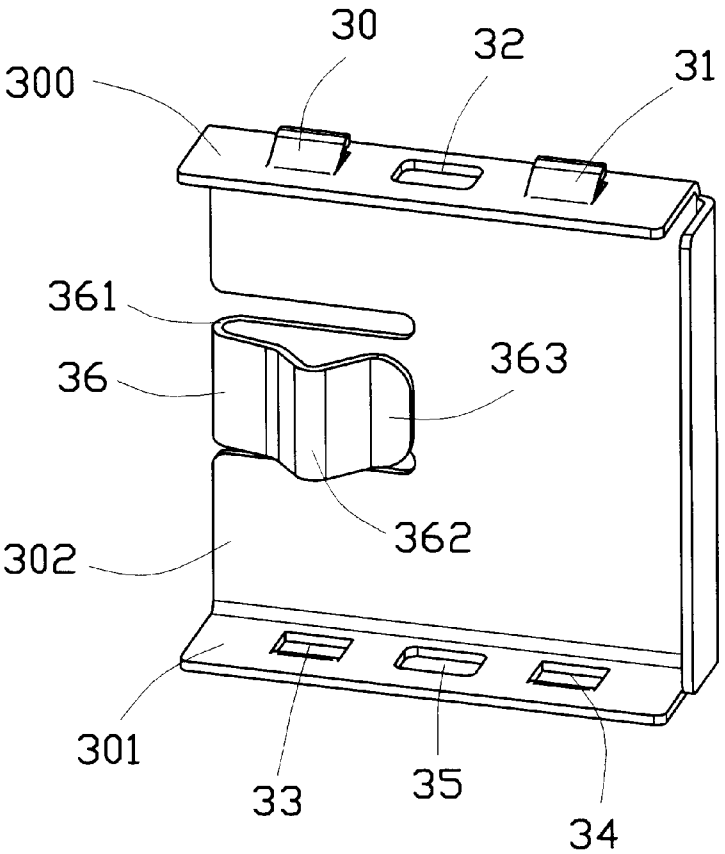
FIG. 5 is a perspective view of a reinforcing part for the shielding of FIG. 1.

Referring to FIGS. 3, 4 and 5, the first shielding 2 defines two engaging holes 20, 21 and 23, 24 respectively in upper portions of the first side face 200 and the second side face 201. Side tabs 25, 26 are respectively formed at middle portions of the side faces 200, 201. Rear tabs 27, 28 are respectively formed at rear edges of the side faces 200, 201. The second shielding 3 comprises a top face 302, a first side face 300 and a second side face 301 extending downward from two opposite edges of the top face 302, and a rear face 303 extending downward from a front edge of the top face 302. Engaging holes 32, 35 are respectively defined in the side faces 300, 301. Two side tabs 30, 31 and 33, 34 are respectively formed in the side faces 300, 301.

Particularly referring to FIG. 5, a grounding tab 36 is formed at the top face 302 of the second shielding 3 and comprising a flat portion 360 substantially coplanar with the top face 302, a first curved portion 361 extending curvedly downward from the flat portion 360, a second curved portion 362, substantially V-shaped extending from the first curved portion 361, and an end portion 363 extending from the second curved portion 362.

Figure 6:
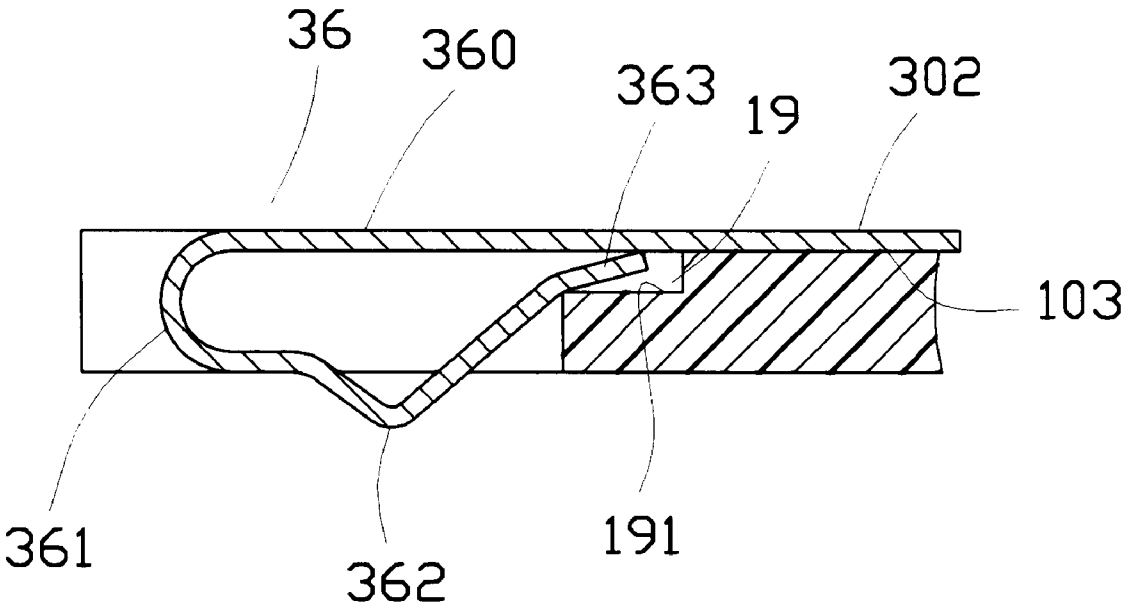
FIG. 6 is a schematic view showing engagement between the shielding structure and the insulative housing of FIG. 3.
Figure 7:
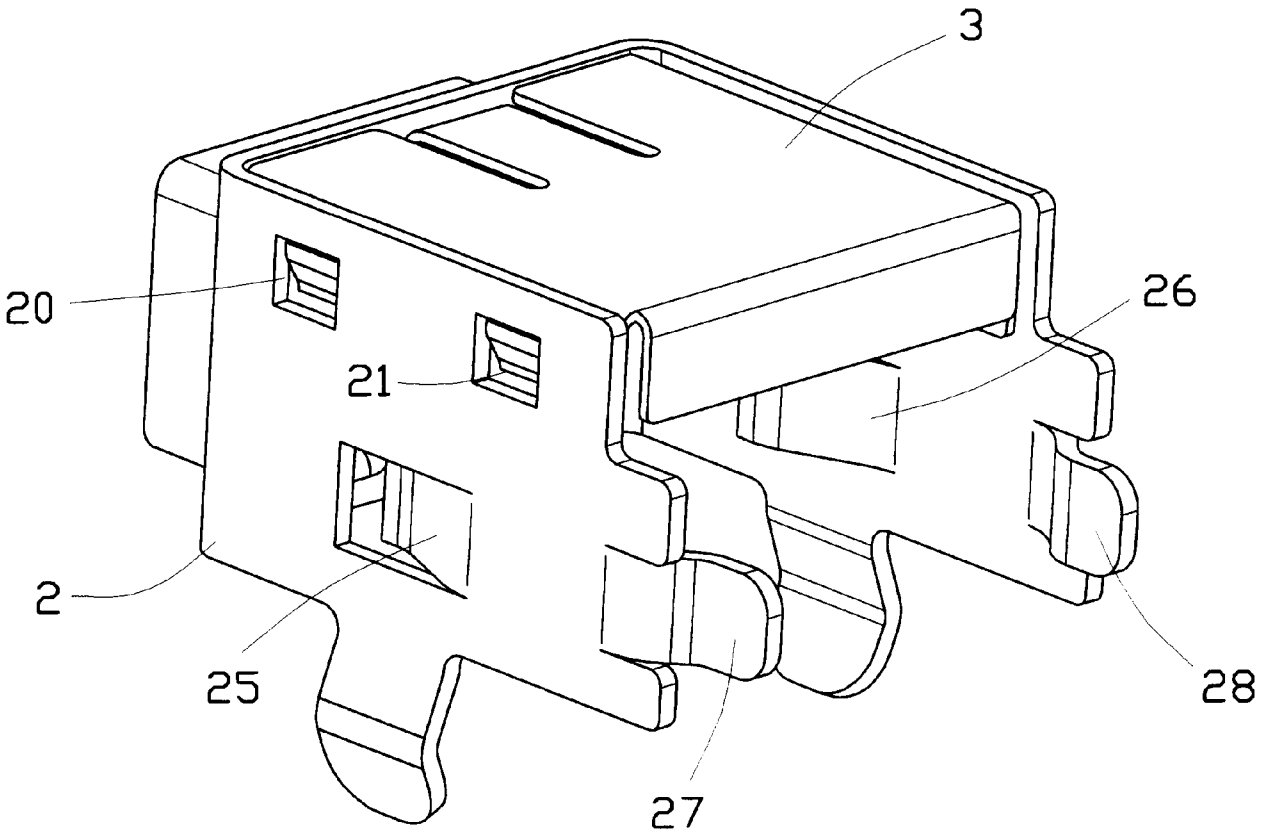
FIG. 7 is an assembled view of the shielding structure of the present invention.

During assembly, the first shielding 2 is firstly assembled to the housing 1 in a horizontal manner from the front face 104 of the housing 1, the side tabs 25, 26 and the rear tabs 27, 28 sliding over the guiding channels 13, 14 until the rear tabs 27, 28 being received in the slots 17, 18 and the first side face 200, the second side face 201, the front face 202 being respectively attached to the first side face 100, the second side face 101, and the front face 104 of the housing 1. Specifically, the side tabs 25, 26 of the first shielding 2 slide over the guiding faces 151, 161 until the end portions thereof abut against the stopping edges 152, 162 of the housing 1. After the first shielding 2 is assembled to the housing 1, the second shielding 3 is then downwardly engaged with the housing 1 and the first shielding 2, with the engaging holes 32, 35 thereof engaged with the tapered protrusions 11, 12 of the housing 1, the end portion 363 of the grounding tab 36 compressively engaged between the flat portion 360 and the ledge 191 of the housing 1 (FIG. 6), and the side tabs 30, 31, 33, 34 thereof respectively engaging with the engaging holes 20, 21, 23, 24 of the first shielding 2. With this grounding tab 36, when the connector of the present invention is mated with a complementary connector(not shown), the grounding tab 36 thereof will be forced to contact with a metallic shielding of the complementary connector thereby increasing grounding area for the two connectors. FIG. 7 illustrates the engagement between the first shielding 2 and the second shielding 3, with the housing 1 being intentionally omitted for illustrative purpose.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

an insulative housing having two side faces connected to a front face and a rear face, a top face connected to the side faces, the front face and the rear face, the side faces each respectively defining a guiding channel along a longitudinal direction thereof, the rear face having two ends respectively extending beyond the side faces and each end defining a slot therein communicating with the guiding channel of the corresponding side face;

a first metallic shielding having a front face and two side faces connected to two ends of the front face, and two rear tabs respectively extending from the side faces for engaging within the slots of the rear face of the housing when the front face and the side faces of the first metallic shielding are in contact with the front face and the side faces of the housing; and a second metallic shielding having a top face and two side faces extending downward from the top face for engagement between the side faces of the first metallic shielding and the side faces of the housing, wherein the top face of the second metallic shielding covers the top face of the housing.

2. The electrical connector as claimed in claim 1, wherein the housing has a first tapered protrusions formed on an upper portion of each side face thereof and the second shielding defines an engaging hole in each side face thereof for engaging with the first tapered protrusion of the second shielding.

3. The electrical connector as claimed in claim 2, wherein the first shielding defines at least one engaging hole in each side face thereof and the second shielding has at least one side tab formed at each side face thereof for engaging with the engaging hole of the first shielding.

4. The electrical connector as claimed in claim 3, wherein the guiding channel of each side face of the housing has a second tapered protrusion formed at one end thereof near the front face of the housing.

5. The electrical connector as claimed in claim 4, wherein the second tapered protrusions has a guiding face and a stopping edge.

6. The electrical connector as claimed in claim 5, wherein the first shielding has a side tab formed in each side face thereof for sliding over the guiding face of the second tapered protrusion during assembly of the first shielding and the housing and finally abutting against the stopping edge of the second tapered protrusion.

7. The electrical connector as claimed in claim 6, wherein the housing defines a cutout in the top face therein and in communication with the front face thereof.

8. The electrical connector as claimed in claim 7 further comprising a ledge projecting from an inner-most wall of the cutout.

9. The electrical connector as claimed in claim 8, wherein the second shielding has a grounding tab formed in the top face thereof for engaging with the ledge of the housing when the second shielding is assembled between the housing and the first shielding thereby increasing grounding area when the electrical connector is engaged with a complementary connector.

10. The electrical connector as claimed in claim 9, wherein the grounding tab of the second shielding has a flat portion substantially coplanar to the top face of the second shielding, a first curved portion extending from the flat portion toward an inner space of the second shielding, and a second curved portion extending from the first curved portion for engaging between the flat portion and the ledge of the housing when the second shielding is assembled to the housing.

11. The electrical connector as claimed in claim 10, wherein the first shielding has a hollow frame extending from the front face thereof and an opening thereof is in communication with internal of the housing.

12. The electrical connector as claimed in claim 11, wherein the hollow frame of the first shielding has a dimple formed at a periphery thereof for prevention of disorientation when a complementary connector is engaged with the electrical connector.

13. An electrical connector comprising:

an insulative housing having two side faces each connected to both a front face and a rear face, and a top face, said top face of the insulative housing defining a cutout therein around the front face;

a first metallic shielding defining a front surface and two first side surfaces connected to two opposite ends of the front surface and two first side surfaces connected to two opposite ends of the front surface for respectively covering said front face and two side faces of the housing;

a second metallic shielding defining a top surface, two second side surfaces and a rear surface wherein said top surface includes a grounding tab extending rearward from a front edge thereof and into said cutout of the top face of the insulative housing, and said second side surface of the second metallic shielding includes means for fastening the first shielding and said second shielding together.

* * * * *